US007370623B1

(12) United States Patent
Solinski et al.

(10) Patent No.: US 7,370,623 B1
(45) Date of Patent: May 13, 2008

(54) ENGINE-POWERED TOOL WITH A TUBE FOR GUIDING A STARTER PULL ROPE

(75) Inventors: Andrew L. Solinski, Texarkana, TX (US); Thomas G. Glore, Texarkana, TX (US); Justin K. Murnan, New Boston, TX (US); Wayne M. Vanlandingham, Texarkana, TX (US); Robert L. Bilimek, Jr., Maud, TX (US)

(73) Assignee: Husqvarna Outdoor Products Inc., Augusta, GA (US)

( * ) Notice: Subject to any disclaimer, the term of this patent is extended or adjusted under 35 U.S.C. 154(b) by 0 days.

(21) Appl. No.: 11/609,073

(22) Filed: Dec. 11, 2006

(51) Int. Cl.
*F02N 3/02* (2006.01)
*F02B 77/04* (2006.01)

(52) U.S. Cl. ..... 123/185.3; 123/198 E; 74/6

(58) Field of Classification Search ..... 123/185.3, 123/185.2, 185.1, 198 E; 185/39; 74/6
See application file for complete search history.

(56) References Cited

U.S. PATENT DOCUMENTS

| | | | | |
|---|---|---|---|---|
| 1,137,314 | A | 4/1915 | Harley | |
| 1,149,978 | A | 8/1915 | Groll | |
| 1,171,170 | A | 2/1916 | Casgrain | |
| 1,182,531 | A | 5/1916 | Doman | |
| 1,196,650 | A | 8/1916 | Bootz | |
| 2,942,599 | A | 6/1960 | Irgens | |
| 3,252,452 | A * | 5/1966 | Burkett et al. | 123/185.2 |
| 3,570,464 | A * | 3/1971 | Morabit et al. | 123/185.2 |
| 4,638,775 | A | 1/1987 | Lindstrom | |
| 5,035,586 | A | 7/1991 | Sadler et al. | |
| 5,329,896 | A * | 7/1994 | Everts | 123/185.3 |
| 5,988,132 | A * | 11/1999 | Watanabe | 123/185.2 |
| 6,776,133 | B2 * | 8/2004 | Tezuka et al. | 123/185.3 |
| 2003/0217723 | A1 | 11/2003 | Aiyama et al. | |
| 2006/0102129 | A1 | 5/2006 | Purdy et al. | |
| 2006/0201125 | A1 | 9/2006 | Docken et al. | |

* cited by examiner

*Primary Examiner*—Stephen K. Cronin
*Assistant Examiner*—Ka Chun Leung
(74) *Attorney, Agent, or Firm*—Pearne & Gordon LLP

(57) ABSTRACT

A tool with an engine, a shaft, and a recoil starter pulley coupled to the shaft for rotation about an axis. A starter pull rope for winding and unwinding around the recoil starter pulley. An air chamber shroud extending about at least a portion of the pulley, the rope extending from the pulley through the shroud. A tube enclosing a portion of the rope and extending from a location adjacent to and aligned with the pulley to a location at an exterior of the shroud that is axially offset from the pulley. The tube may have flared ends to reduce gradual wear of the rope. The tube alters a trajectory of the pull rope to be substantially offset from the plane of the starter pulley so as to avoid interfering with neighboring structures inside the tool.

13 Claims, 6 Drawing Sheets

ENGINE-POWERED TOOL WITH A TUBE FOR GUIDING A STARTER PULL ROPE

FIELD OF INVENTION

The present invention relates to an engine-powered tool that has a starter pull rope.

BACKGROUND OF THE INVENTION

A pull rope for starting an engine is well known in the art and an engine that has a pull-rope may power a variety of manually operated tools, such as a chain saw, an air blower/vac or a lawn mower. The pull rope is attached at one end to a pulley that is in turn attached to a shaft of the engine. Often, a shroud or cover encloses the pulley and the pull rope extends out through the shroud.

One conventional structural arrangement is that a section of the pull rope that is between the pulley and the shroud lies within a plane of the starter pulley. Specifically, the rope section lies in the plane or at most nominally offset from the plane. Such an arrangement of the starter pull rope is acceptable so long as no inner structure of the tool is positioned to interfere with the rope.

In a conventional full crank engine as shown in FIG. 1, the shaft extends on both sides of the engine. Thus, the shaft is long enough to accommodate a flywheel on one side of the engine and a starter pulley on the other side engine. In a powered air blower/vac tool using a half-crank engine, the shaft does not offer as much space as a full-crank engine on which to install the starter pulley.

FIG. 1 shows a prior art device in the form of a full crank engine 100 with a pull-rope starter assembly arranged in a conventional manner. From the view shown in FIG. 1, a flywheel 125 that includes a magnet is located to the left side of an engine casing 101 on a shaft 115 and the rope-starter assembly is located on the right side. The rope-starter assembly includes a handle 145 that is fastened to one end of a starter pull rope 140. The pull rope 140 is within a center plane of a starter pulley 120 or nominally offset from the plane. Because the shaft 115 of the full crank engine 100 passes completely through the engine casing 101 and is located on both sides of the engine casing 101, the rope-starter assembly, with the starter pulley 120 and the pull rope 120, can also be installed to avoid interference with other components.

SUMMARY OF THE INVENTION

In accordance with one aspect, the present invention provides a tool with an engine, a shaft extending from the engine, and a recoil starter pulley coupled to the shaft for rotation about an axis. The tool has a starter pull rope for winding and unwinding around the recoil starter pulley to start the engine. The tool has an air chamber shroud extending about at least a portion of the pulley. The rope extends from the pulley past the shroud. The tool has a tube enclosing a portion of the rope and extending from a location adjacent to and aligned with the pulley to a location at an exterior of the shroud that is axially offset from the pulley.

In accordance with another aspect, the present invention provides a tool with an engine, a shaft extending from the engine, and a recoil starter pulley coupled to the shaft for rotation about an axis. The tool has a starter pull rope for winding and unwinding around the recoil starter pulley to start the engine. The tool has a housing having a scroll air chamber space extending about at least a portion of the pulley. The tool has a tube enclosing a portion of the rope and extending from a location adjacent to the pulley to a location outside of the scroll air chamber of the housing, without penetration of the air chamber space.

In accordance with another aspect, the present invention provides a tool that has a shroud, an engine part inside the shroud, and a shaft powered by the engine part. The tool has a recoil starter pulley coupled to the shaft and lying in a plane, and a starter pull rope wound around the recoil starter pulley. The starter pull rope includes a first rope end fastened to the recoil starter pulley and a second rope end fastened to a pull handle. The tool has a tube having ends, allowing passage of the starter pull rope out of the shroud and forming a trajectory within the shroud, wherein a part of the trajectory is substantially offset from the plane.

In accordance with another aspect, the present invention provides a tool that has a shroud, an engine part inside the shroud, and a shaft powered by the engine part. The tool has a recoil starter pulley coupled to the shaft and lying in a plane, and a starter pull rope wound around the recoil starter pulley. The rope includes a first rope end fastened to the recoil starter pulley and a second rope end fastened to a pull handle. The tool has a tube having ends, allowing passage of the starter pull rope out of the casing, wherein the ends of the tube are flared to prevent wear of the starter pull rope.

DESCRIPTION OF EXAMPLE EMBODIMENTS

Figure 1:
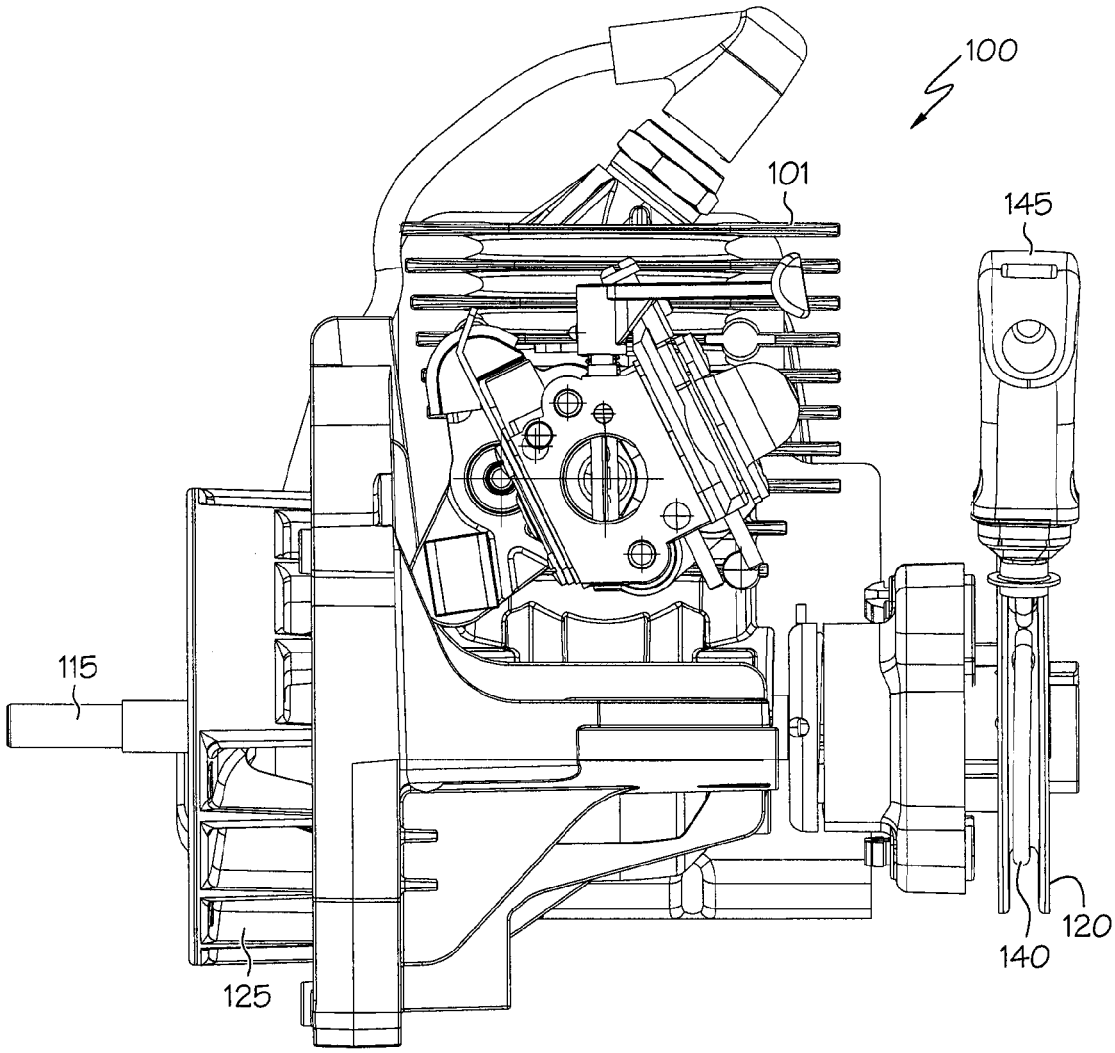
FIG. 1 (PRIOR ART)
FIG. 1 is a view of a full crank engine of the prior art.
Figure 2A:
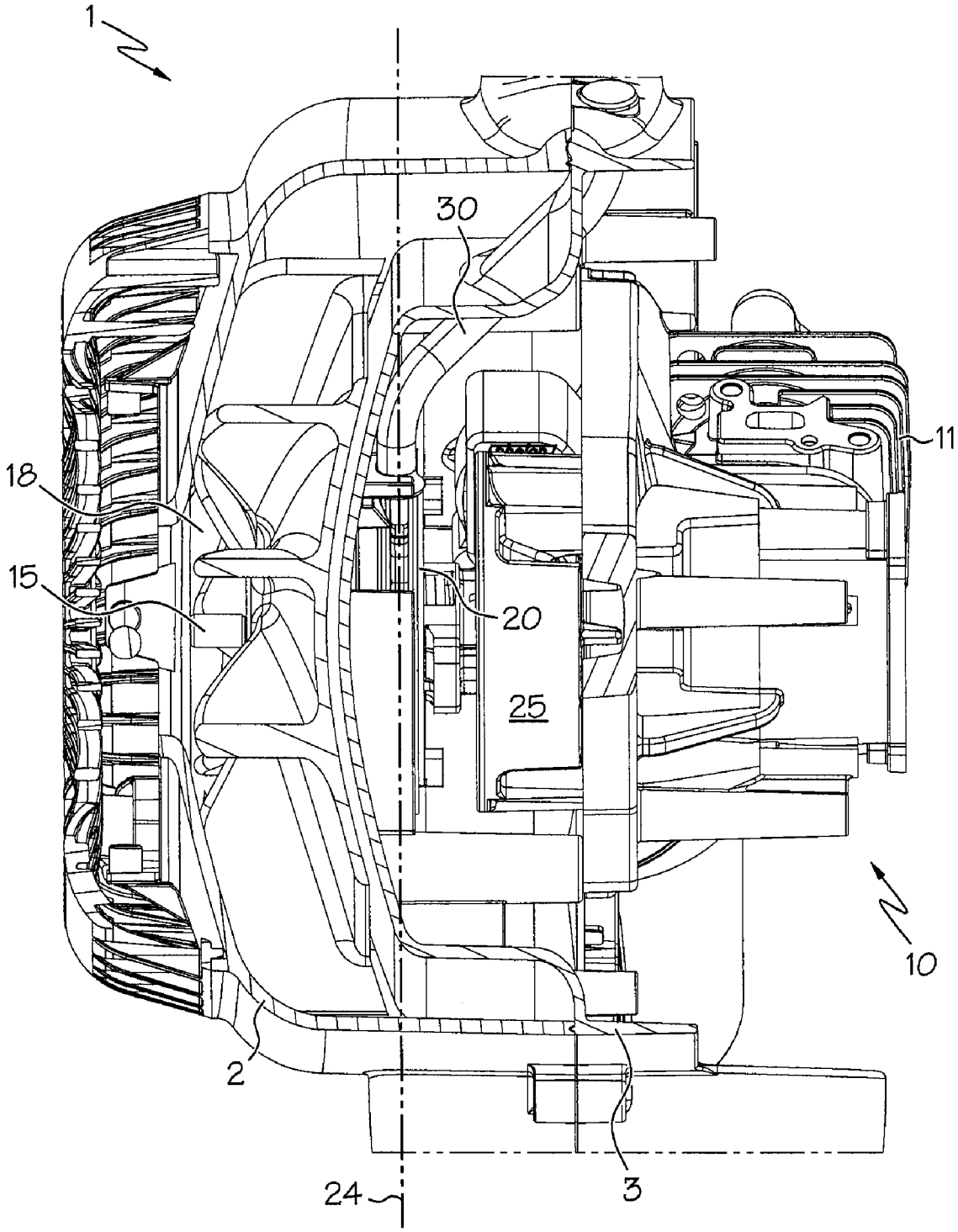
FIG. 2A is a first cut-away view of an air blower/vac tool powered by a half crank engine with a starter pull rope tube in accordance with one aspect of the present invention, but with a pull rope removed to permit viewing of other parts.

An example of the present invention will now be described in the context of a power blower/vac tool 1 (FIG. 2A). However, a person of ordinary skill in the art will appreciate that the present invention can be used in any tool that uses a pull-rope-started engine.

A half crank engine 10 within a blower/vac tool 1 is shown in FIG. 2A. A shaft 15 of the half crank engine 10 extends from one side of an engine casing 11 toward an air chamber space 18. In the view shown in FIG. 2A, the shaft 15 extends to the left of the engine casing 11. Since the shaft 15 only extends to one side of the engine casing 11, all the parts that are external to the engine 10 and that are coupled to the shaft are located on the same side of the engine casing 11 (i.e., the left side as shown in FIG. 2A). In particular, a flywheel 25, which is mounted on the shaft 15, is on the same side of the engine casing 11 as a rope-starter assembly. Specifically, a starter pulley 20, which part of the rope-starter assembly, is mounted on the shaft 15 on the same side of the engine casing 11 as the flywheel 25 and the air chamber space 18.

It should be appreciated that an associated starter pull rope 40 (not shown in FIG. 2A, see FIG. 5) is also part of the rope-starter assembly. The pull rope 40 is fastened at one end to the starter pulley 20 and is wound in a groove in the perimeter of the starter pulley 20. A pull handle 45 is attached to a second end of the pull rope 40. A person of ordinary skill in the art will appreciate the additional associated structure of the rope-starter assembly (e.g., a biasing return mechanism or spring, a one-way engagement pawl arrangement, etc.) and the general operation and function of the rope-starter assembly. In short summary, a manual pull on the pull rope 40 (i.e., rope movement in the manner indicated by the change from FIG. 4 to FIG. 5) rotates the starter pulley 20 and thus the shaft 15. The rotation causes the engine 10 to start. Subsequent to the pull, the biasing return mechanism coils the pull rope back onto the starter pulley 20 and thus returns the handle 45 to the position shown in FIG. 4.

Of course, the configuration of the half crank engine 10 mandates that components cannot be relocated to the other side of the engine casing 11. Thus, the close proximity of the components can result in a hindrance concern. In particular, the pull rope 40 could result in a hindrance concern.

Figure 2B:
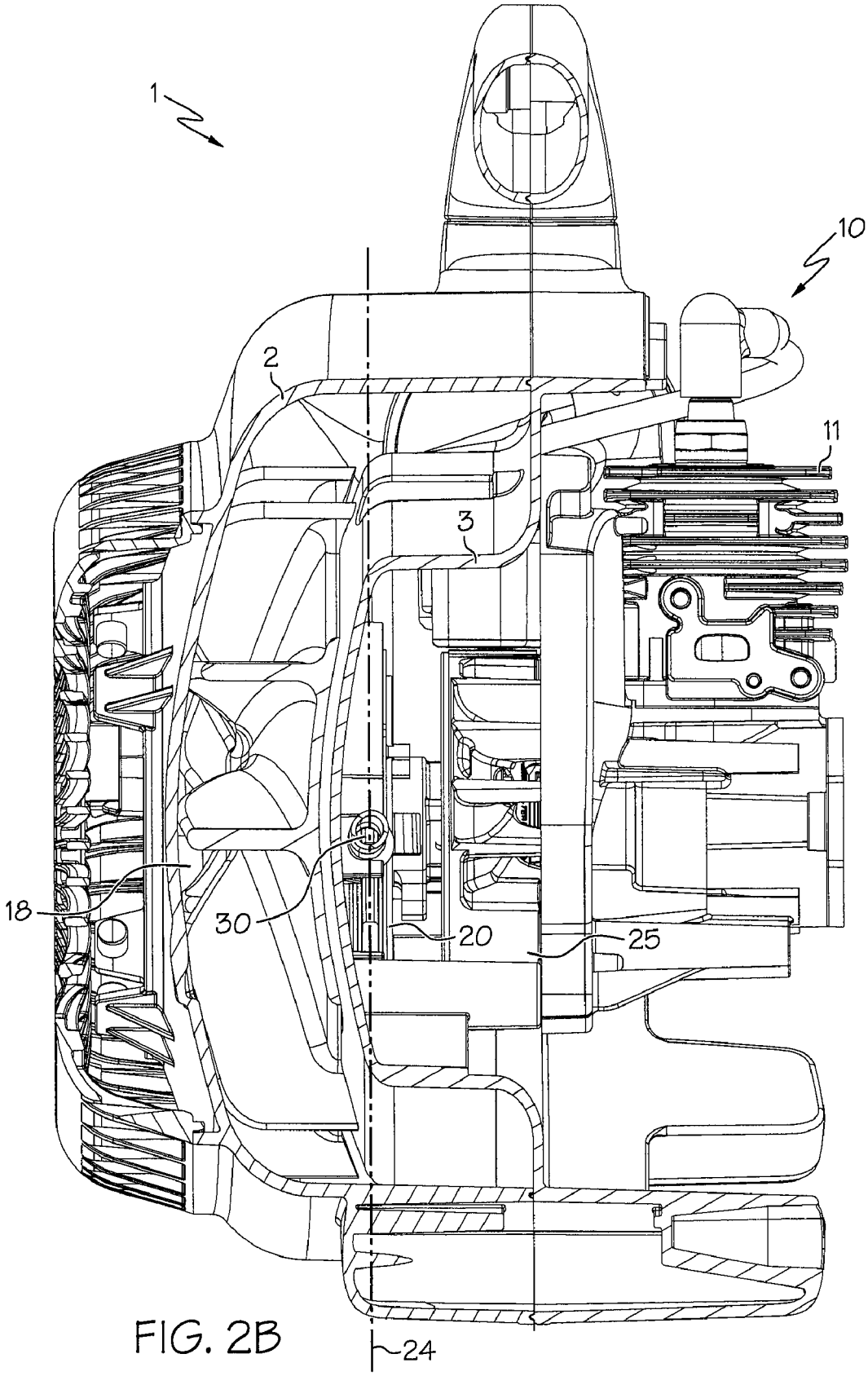
FIG. 2B is a second cut-away view of the air blower/vac tool of FIG. 2A from a different vantage point.

Turning now to details of the shown example, FIGS. 2A and 2B show that the air chamber space 18 is provided by a left scroll 2 and a right scroll 3. The scrolls 2, 3 provide for an air flow pathway. The scrolls 2, 3 also act as a part of the overall housing or shroud concealing portions of the blower/vac tool 1. In particular, the scrolls 2, 3 and the rest of the housing act to shroud the starter pulley 20.

As mentioned, the starter pulley 20 rotates upon the axis of the shaft 15. Thus, the starter pulley 20 rotates in a plane 24 that is perpendicular or transverse to the rotational axis of the shaft 15. The rotational plane 24 can be defined as a center plane that passes through the starter pulley 20. The plane 24 also intersects parts of the scrolls 2, 3 and part of the air chamber space 18 defined by the scrolls 2, 3. It should be appreciated that if the pull rope 40 only extended within the plane 24 or just nominally offset from the plane, the pull rope 40 would have to extend through the scrolls 2, 3 and the air chamber space 18. In order for the pull rope 40 to extend through the scrolls 2, 3 and the air chamber space 18, holes would be needed through the scrolls 2, 3. Such an arrangement could disturb air flow within the air chamber space 18 and possible could disturb the performance of the air blower/vac tool 1. Moreover, the pull rope 40 could gradually wear out due to particulate matter (e.g., mulched debris) flowing with the air flow within the air chamber space 18.

However, in accordance with one aspect of the present invention, FIG. 2A shows a tube 30 for routing the pull rope 40. The pull rope tube 30 solves the above mentioned issues by routing the pull rope 40 out of the plane 24 of the starter pulley 20 in order to avoid penetration of the air chamber space 18. In particular, FIG. 2A shows that the example tube 30 has a portion that is axially offset (i.e., along the axis of the shaft 15) from the plane 24. Within the shown example, the tube 30 has two bends. A first bend, which is closest to the starter pulley 20, is such that the tube is directed at an angle from the plane 24. A second bend, which is furthest from the starter pulley 20, is such that the tube is redirected generally parallel to the plane 24 but off-set from the plane. The path of the tube 30 including the bends can be referred to as routing or trajectory 34. The bends in the example tube are curved. Thus, in the shown example, the routing or trajectory 34 is S-shaped. It is to be appreciated that the routing or trajectory may differ and that the different routing or trajectory is within the scope of the invention. For example, in a different embodiment, the tube 30 may simply have a substantially linear trajectory 34. Within another example, a different number of bends could be utilized. Still further, within a different embodiment, the bend(s) can have a different shape (e.g., angular instead of curved). The trajectory 34 of the tube 30 will depend on the shape of neighboring structures for which the tube 30 is designed for pull rope interference. The present invention is meant to encompass tube structures of all shapes that provide routing to avoid hindering neighboring structures.

It is to be noted that the tube may have other features, including structure features. Also, some of the features may or may not be associated with avoidance of hindering neighboring structures. For example, the tube may also be configured, via one or more bends to have an arc extent about the rotational axis of the shaft 15. As shown in shown within the example of FIG. 4, the tube 30 can be divided into three portions, i.e., two end portions 35, 37 and a middle portion 36. The end portions 35, 37 are offset in a parallel manner while the middle portion 36 is slanted to create an offset. As can be appreciated, the offset provides an arc extent about the shaft 15. It is to be appreciated that within the shown example, the bends within the tube 30 provide both the axial offset from the rotational plane 24 of the starter pulley 20 and the arc extent about the pulley.

Figure 3:
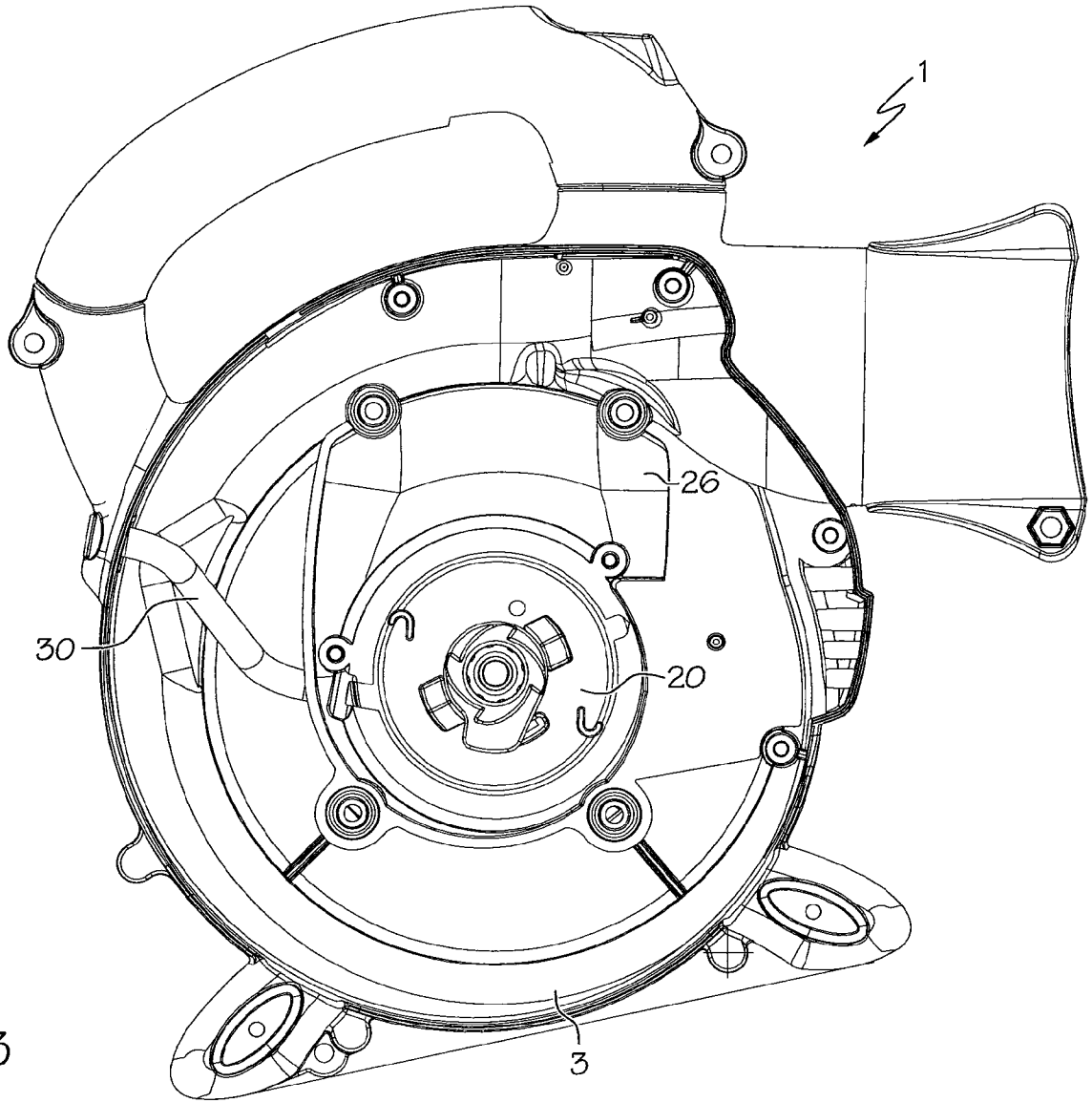
FIG. 3 is a side cut-away view of the interior of the air blower/vac tool of FIGS. 2A and 2B.
Figure 4:
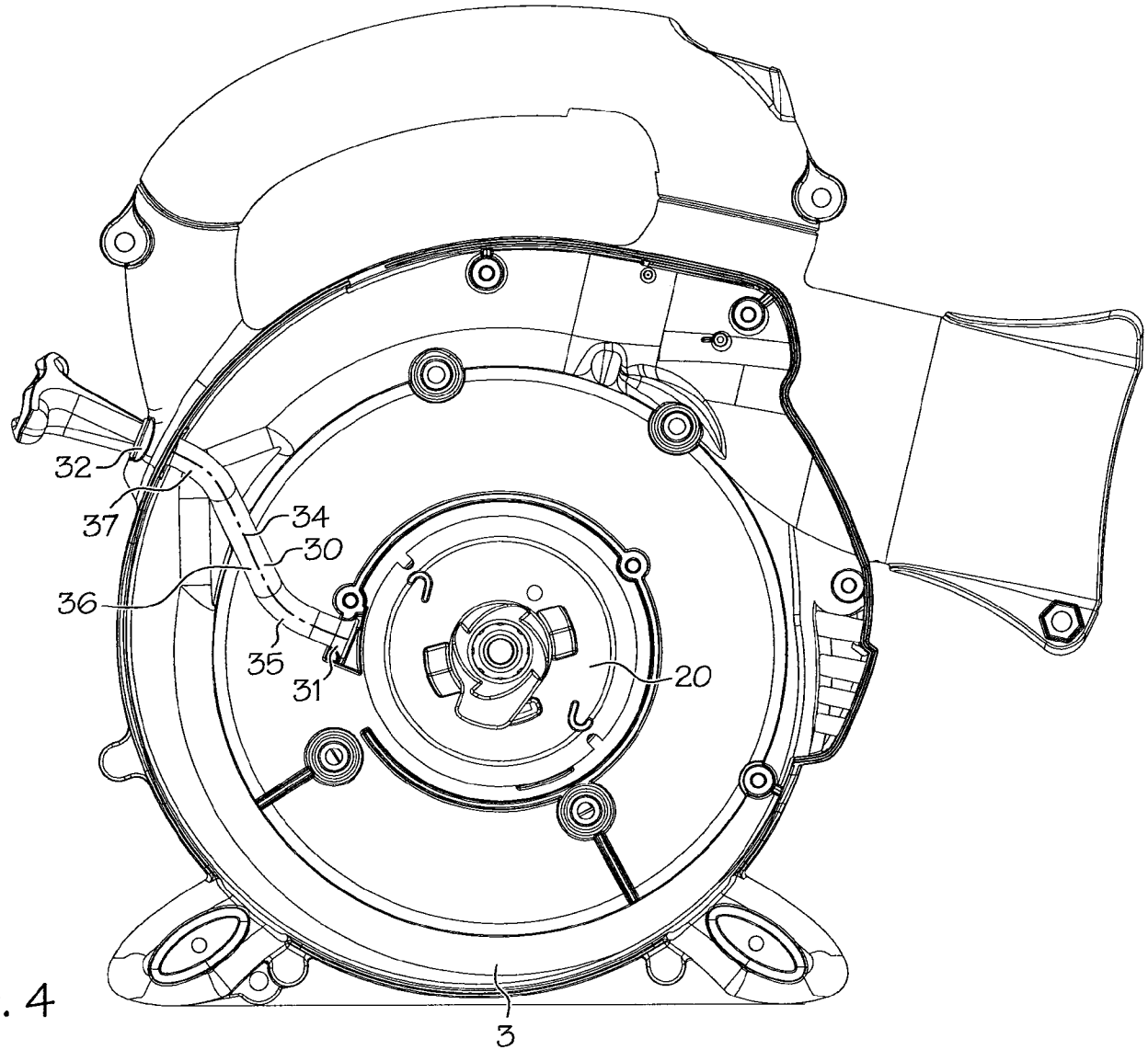
FIG. 4 is a view of the air blower/vac tube similar to FIG. 3, but with certain parts removed and showing the pull rope in a first position state.
Figure 5:
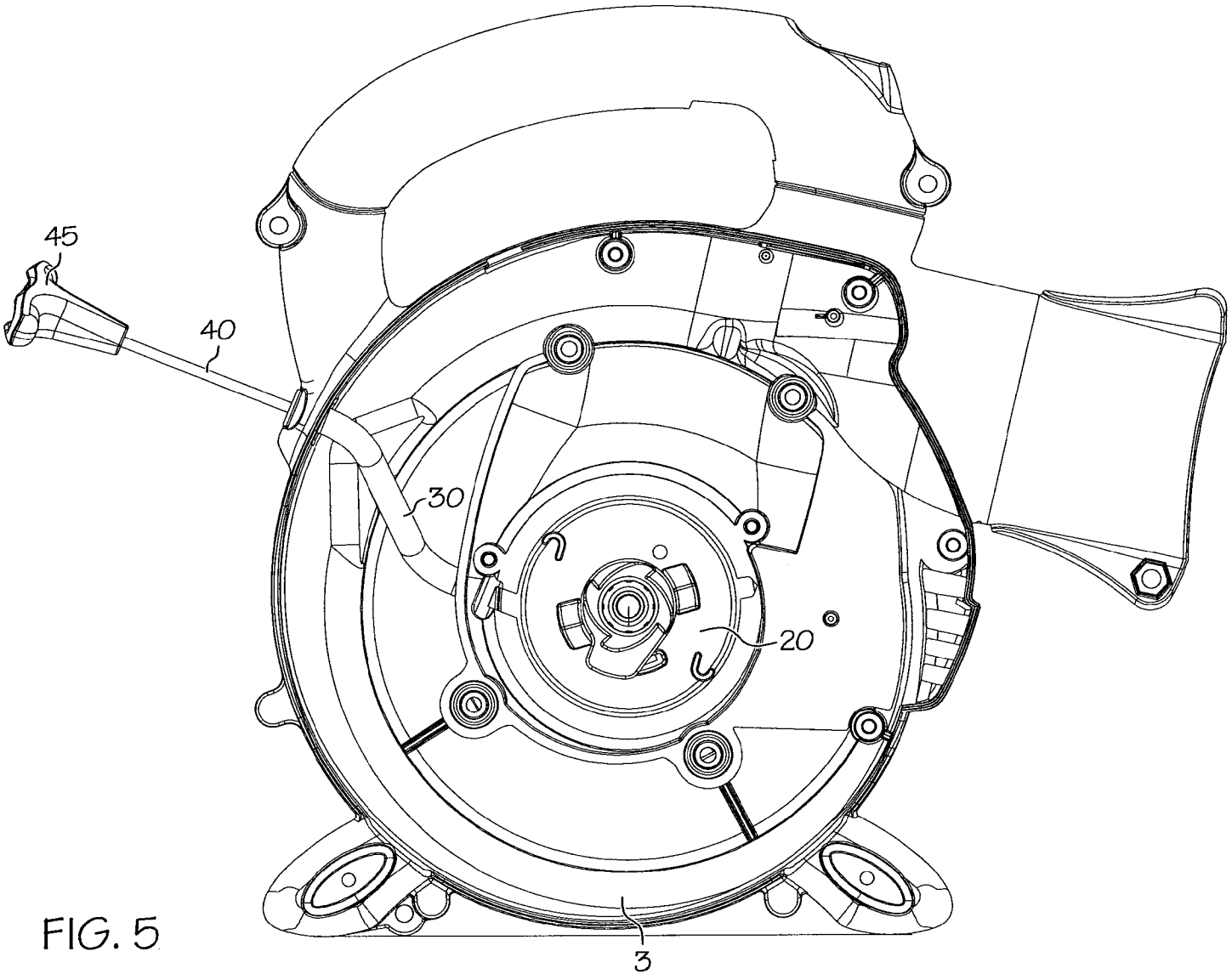
FIG. 5 is a view similar to FIG. 4 and showing the pull rope in a first position state.

A further review of the drawings show example details associated with such other features. FIGS. 3-5 show example details of the interior of the air blower/vac tool 1 and specifically show the tube 30 in relation to the starter pulley 20 and the surrounding structures. Specifically, FIGS. 3-5 show the details of the associated with the other features. Turing to FIG. 3, a baffle 26 is shown. As shown in FIG. 4, a portion of the baffle 26 clamps one end 31 of the tube 30 against the right scroll 3.

The other end 32 of the tube 30 is clamped between the left scroll 2 and the right scroll 3. This structure can best be appreciated by viewing both FIGS. 2A and 4. As such, the end 32 is the radially outermost end of the tube 30. Also, as shown in FIG. 4, the pull handle 45 may engage the outmost end of the tube 30.

In accordance with other example features, the tube 30 may be made of metal but could be made of any material sufficiently rigid to withstand the forces exerted by the pull rope 40 on the inner surface of the tube 30 at the time of pulling. Moreover, instead of being an element distinct from the scrolls, as in the present example, a tube could be molded as part of another element, such as the right scroll 3.

In accordance with other example features, the tube ends 31, 32 are flared to eliminate sharp edges that can gradually wear down the pull rope 40 as it rubs against the surface of the tube 30 when it enters or exits at an angle. Such shape of the ends 31, 32 can be attained by either molding the tube in that manner or attaching separate elements at the ends of the tube 30.

The pull rope 40 is made of material that can slide smoothly against the inner surface of the tube 30. One example of the pull rope 40 is a cord made up of twisted strands or fibers. Of course, various other materials and structures could be used for the pull rope 40. For example, a metal chain could also be used instead of a cord.

Although the present embodiment of the invention overcomes the inadequacies of a device using a half crank engine, a person of ordinary skill in the art will appreciate that the invention can also be used to overcome similar problems in full crank engines when routing of the starter pull rope is beneficial to performance.

What is claimed is:

1. A tool comprising:

an engine;

a shaft extending from the engine;

a recoil starter pulley coupled to the shaft for rotation about an axis;

a starter pull rope for winding and unwinding around the recoil starter pulley to start the engine;

an air chamber shroud extending about at least a portion of the pulley, the rope extending from the pulley through the shroud; and a tube enclosing a portion of the rope and extending from a location adjacent to and aligned with the pulley to a location at an exterior of the shroud that is axially offset from the pulley, wherein the tool is a blower/vac, and wherein the blower/vac has an air chamber space; wherein the plane of the recoil starter pulley intersects the air chamber space; and wherein the tube and the rope do not penetrate the air chamber space.

2. The tool of claim 1, wherein the engine is a half-crank engine.

3. The tool of claim 1, wherein the tube is substantially completely inside the shroud.

4. The tool of claim 1, wherein a first end of the tube is adjacent to the recoil starter pulley.

5. The tool of claim 1, wherein a second end of the tube is adjacent to the casing.

6. The tool of claim 1, wherein the tube is made of metal.

7. A tool comprising:

an engine;

a shaft extending from the engine;

a recoil starter pulley coupled to the shaft for rotation about an axis;

a starter pull rope for winding and unwinding around the recoil starter pulley to start the engine;

a housing having a scroll air chamber space extending about at least a portion of the pulley; and a tube enclosing a portion of the rope and extending from a location adjacent to the pulley to a location outside of the scroll air chamber of the housing, without penetration of the air chamber space.

8. The tool of claim 7, wherein the tool is a blower/vac.

9. The tool of claim 7, wherein the recoil starter lies in a plane and the tube has ends, allowing passage of the starter pull rope out of the housing and forming a trajectory within the housing, wherein a part of the trajectory is substantially offset from the plane.

10. The tool of claim 7, wherein the tube has ends, and at least one of the ends is flared to prevent wear of the starter pull rope.

11. The tool of claim 7, wherein the tube has ends and the scroll air chamber is at least partially defined by a first scroll and a second scroll, and one end of the tube is clamped between the first and second scrolls.

12. A tool comprising:

a shroud having a scroll air chamber space extending about at least a portion of the shroud;

an engine part inside the shroud;

a shaft powered by the engine part;

a recoil starter pulley coupled to the shaft and lying in a plane;

a starter pull rope wound around the recoil starter pulley and including a first rope end fastened to the recoil starter pulley and a second rope end fastened to a pull handle; and a tube having ends, allowing passage of the starter pull rope out of the shroud to a location outside of the scroll air chamber, without penetration of the air chamber space, and forming a trajectory within the shroud, wherein a part of the trajectory is substantially offset from the plane.

13. A tool comprising:

a shroud having a scroll air chamber space extending about at least a portion of the shroud;

an engine part inside the shroud;

a shaft powered by the engine part;

a recoil starter pulley coupled to the shaft and lying in a plane;

a starter pull rope wound around the recoil starter pulley and including a first rope end fastened to the recoil starter pulley and a second rope end fastened to a pull handle; and a tube having ends, allowing passage of the starter pull rope out of the shroud to a location outside of the scroll air chamber, without penetration of the air chamber space, wherein the ends of the tube are flared to prevent wear of the starter pull rope.

* * * * *